US006305025B1

(12) United States Patent
Pilon

(10) Patent No.: US 6,305,025 B1
(45) Date of Patent: Oct. 23, 2001

(54) PERMANENTLY KNOTTED TIE

(76) Inventor: Larry J. Pilon, 1215 Notre Dame St., Cornwall (CA), K6J 4Y7

( * ) Notice: Subject to any disclaimer, the term of this patent is extended or adjusted under 35 U.S.C. 154(b) by 0 days.

(21) Appl. No.: 09/519,742

(22) Filed: Mar. 6, 2000

(51) Int. Cl.[7] ..... A41D 25/04
(52) U.S. Cl. ..... 2/145; 2/156
(58) Field of Search ..... 2/144, 145, 149, 2/150, 152.1, 153, 155, 156, 157

(56) References Cited

U.S. PATENT DOCUMENTS 3,405,408 * 10/1968 Baker ..... 2/145
3,737,917 * 6/1973 Orr ..... 2/150

* cited by examiner

*Primary Examiner*—John J. Calvert
*Assistant Examiner*—Tejash Patel
(74) *Attorney, Agent, or Firm*—Richard J. Hicks

(57) ABSTRACT

A permanently knotted tie having an adjustable neck band is described. The tie comprises a tapered tubular section having a tie front section depending longitudinally therefrom and a tailpiece section depending longitudinally therefrom in the opposite direction to the front section. The tailpiece section is passed around the wearer's neck and the free end thereof is inserted through the tubular section to lie behind the front section, when viewed from the front. Releasable fastening means are provided to releasably secure the tailpiece section to either the front section or the tubular section.

6 Claims, 2 Drawing Sheets

PERMANENTLY KNOTTED TIE

FIELD OF THE INVENTION

This invention relates to an improved necktie, and in particular to a permanently knotted necktie having an adjustable neck band.

BACKGROUND OF INVENTION

Neckties are an essential feature of modern dress in most Western nations and others, and are generally fabricated from a woven or knitted material and even from soft flexible leather strips. Wool, silk, polyester and other synthetic materials are all conventional materials for use in ties. Ties are frequently cut on the bias so as to provide a smooth finish and to hold shape. Tying a tie each time it is worn is, however, tedious and difficult for anyone lacking arm mobility or other physical disabilities. Young children often lack the manual dexterity needed to tie a conventional necktie neatly. Numerous variations of permanently knotted neckties have been patented and generally provide some form of clip-on in which the the knot is preformed by the manufacturer and the neckband is severed and the ends thereof are provided with fastening devices. Adjusting the neck band of such ties to accomodate different diameter necks is, however, a problem and once a suitable length has been selected it is usually difficult to adjust during wear so that the wearer cannot readily loosen the tie should the need arise. There is, therefore, a need for a preformed tie the neckband of which can be adjusted easily by the wearer to any desired tightness without recourse to fasteners under the collar, and yet which is simple to put on and adjust.

OBJECT OF INVENTION

It is an object of the present invention to provide a permanently knotted necktie the neck band of which can be adjusted freely from the front without recourse to fastening devices at the back of the neck or under the wearer's collar.

BRIEF STATEMENT OF INVENTION

By one aspect of this invention there is provided a permanently knotted necktie, fabricated from a planar flexible material, comprising:

(a) a tapered tubular section having a larger diameter end and a smaller diameter end;

(b) a longitudinally extending front section, secured to said smaller diameter end of said tubular section in a plane parallel a longitudinal axis of said tubular section, and adapted to simulate a conventional tie front shape;

(c) a longitudinally extending rear section, secured to said larger diameter end of said tubular section in a plane parallel said longitudinal axis of said tubular section and extending in a direction opposite to that of said front section, and adapted to pass around the neck of a wearer and so that the free end thereof can be passed through said tubular section from the larger diameter end and behind said front section, when viewed from the front; and (d) means to releasably secure said rear section to at least one of tubular section and said front section.

DETAILED DESCRIPTION OF PREFERRED EMBODIMENTS

Figure 1:
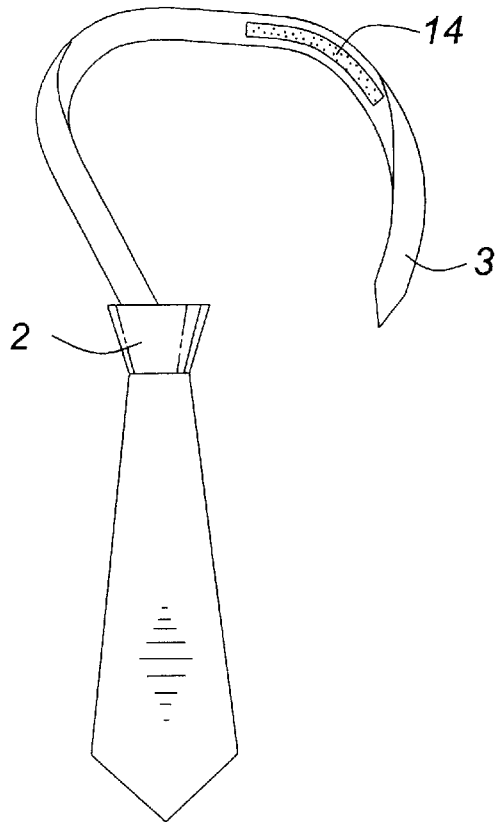
FIG. 1 is a front view of the tie of the present invention.
Figure 2:
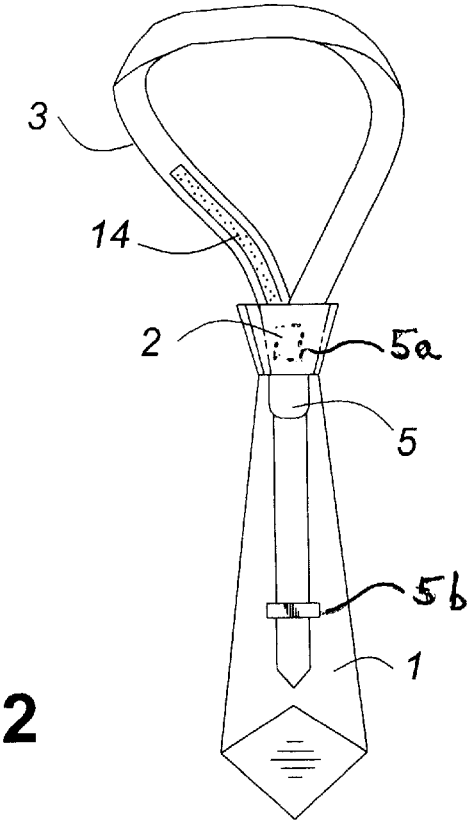
FIG. 2. is a rear view of the tie of FIG. 1.

As seen in FIG. 1, the tie of the present invention comprises three principal segments, namely a front flexible planar section 1, a somewhat narrower flexible planar rear section 3 and a tapered tubular section 2, fabricated from the same material as sections 1 and 3. The front section 1 is permanently attached to the smaller diameter end of tubular section 2 so that it extends longitudinally parallel to the axis of tubular section 2. The rear section 3 is permanently attached to the larger diameter end of section 2 so that it extends longitudinally parallel to the axis of tubular section 2 in the opposite longitudinal direction to front section 1. Intermediate the ends of rear section 3, on the rear face thereof, there is provided a strip of the fuzz (or female) side of a "Velcro" fastener 14. In a preferred embodiment, as shown in FIG. 2, the hook (or male) side of a "Velcro" fastener 5 is provided as a dependent tab extending from the back of tubular section 2. It will be appreciated, however, that the exact placement of tab 5 is a matter of some choice and it can equally well be placed on an inner surface of tubular section 2, or even on the rear face of section 1. It will also be appreciated that a "Velcro" fastener is merely a preferred embodiment and that there are many alternative releasable fastening means, such press studs and the like that could be used.

Figure 3:
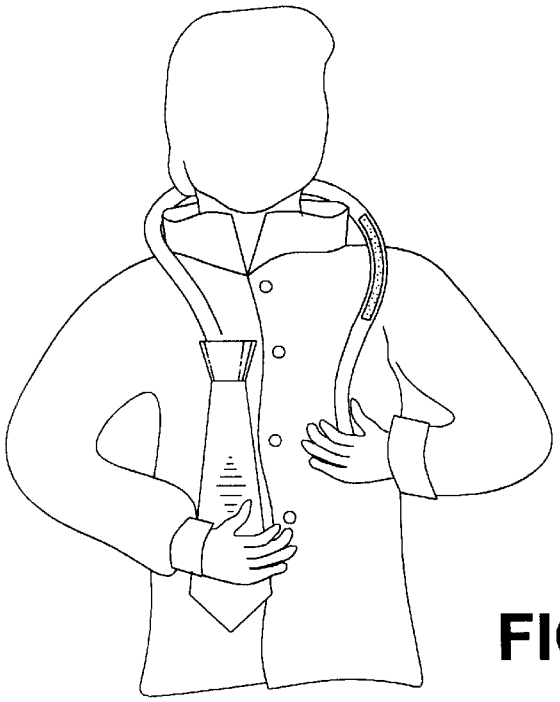
FIGS. 3, 4 and 5 are sketches illustrating the sequence for putting on the tie of FIGS. 1 & 2.
Figure 4:
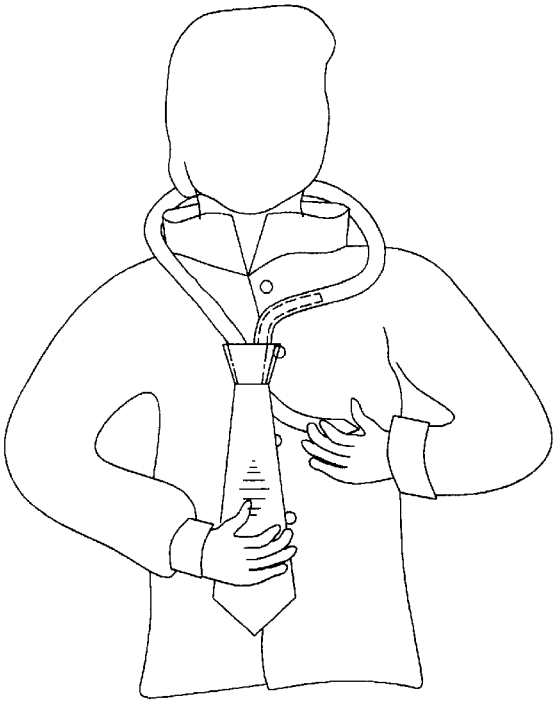
Figure 5:
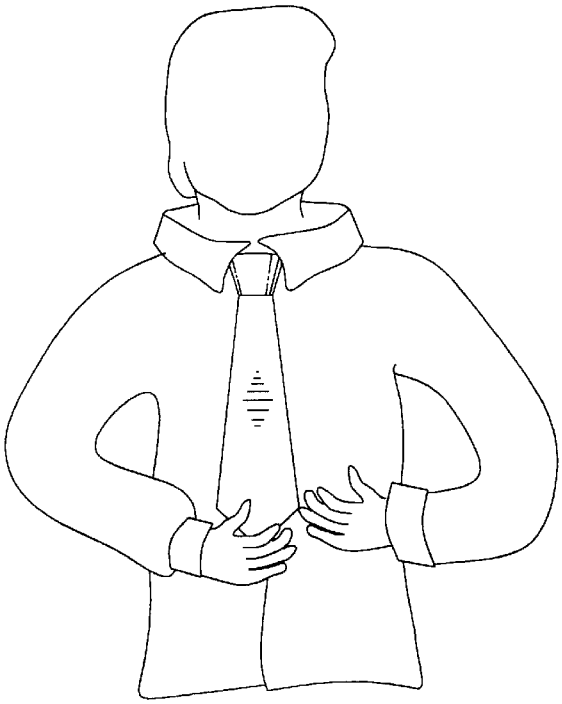

In order to put on the tie of the present invention it is merely necessary to pass the rear section 3, or tail, of the tie around the neck, as seen in FIG. 3. The tail end of section 3 is then passed through the middle of the tubular section 2, so that it lies behind front section 1, when viewed from the front, as seen in FIG. 4. The tail end of section 3 is then pulled downwardly so as to draw the tubular section 2 upwardly so that it lies snuggly under the chin and tail 3 forms a comfortably tight loop around the neck, as seen in FIG. 5. When the tie is in the position as shown in FIG. 5, the Velcro strip 14 engages with Velcro tab 5 so as to hold sections 1 and 3 in fixed, but adjustable, relationship. In order to remove the tie it is merely necessary to grip section 2 above the tubular section between two fingers of one hand and with the other hand draw the tubular section 2 downwardly from the neck, and withdraw section 3 from tubular section 2.

What is claimed is:

1. A permanently knotted necktie, fabricated from a planar flexible material, comprising:

(a) a tapered tubular section having a larger diameter end and a smaller diameter end;

(b) a longitudinally extending front section, secured to said smaller diameter end of said tubular section in a plane parallel a longitudinal axis of said tubular section, and adapted to simulate a conventional tie front shape;

(c) a longitudinally extending rear section, secured to said larger diameter end of said tubular section in a plane parallel said longitudinal axis of said tubular section and extending in a direction opposite to that of said front section, and adapted to pass around the neck of a wearer as an unbroken loop and so that the free end thereof passes through said tubular section from the larger diameter end and behind said front section, when viewed from the front; and (d) means to releasably secure said rear section to at least one of tubular section and said front section.

2. A permanently knotted necktie as claimed in claim 1, wherein said means to secure said rear section comprises a hook and loop fastener.

3. A permanently knotted necktie as claimed in claim 2, wherein one half of said hook and loop fastener is secured to said rear section so as to releasably engage with a complimentary portion thereof secured to said tubular section.

4. A permanently knotted necktie as claimed in claim 3, wherein said complementary portion comprises a tab depending from said tubular section.

5. A permanently knotted necktie as claimed in claim 3 wherein said complementary portion is secured to an inner surface of said tubular section.

6. A permanently knotted necktie as claimed in claim 3, wherein said complementary portion is secured to a rear planar face of said front section.

* * * * *